US010667355B1

(12) United States Patent
Toth

(10) Patent No.: US 10,667,355 B1
(45) Date of Patent: May 26, 2020

(54) SYSTEM FOR ELECTRICAL LIGHTING FIXTURES

(71) Applicant: Zoltan Toth, Brooklyn, NY (US)

(72) Inventor: Zoltan Toth, Brooklyn, NY (US)

( * ) Notice: Subject to any disclaimer, the term of this patent is extended or adjusted under 35 U.S.C. 154(b) by 0 days.

(21) Appl. No.: 16/406,731

(22) Filed: May 8, 2019

(51) Int. Cl.
*H05B 45/10* (2020.01)
*H05B 47/10* (2020.01)
*H05B 45/37* (2020.01)

(52) U.S. Cl.
CPC ..... *H05B 45/10* (2020.01)

(58) Field of Classification Search
CPC ..... H05B 33/086; H05B 37/0272; H05B 37/029; H05B 33/0863; H05B 37/0227; H05B 33/0845; H05B 33/0815; H05B 33/0809
USPC ..... 315/250, 121, 294, 312, 113
See application file for complete search history.

(56) References Cited

U.S. PATENT DOCUMENTS 5,149,185 A * 9/1992 Mandy ..... H02J 9/061 307/66
6,628,083 B2 * 9/2003 Pickering ..... H02J 9/065 315/160
2011/0074542 A1 * 3/2011 Nabeshima ..... H05B 37/0272 340/5.62
2011/0141647 A1 * 6/2011 Garcia ..... H01H 23/145 361/166
2017/0061785 A1 * 3/2017 Zinger ..... G08C 19/02

* cited by examiner

*Primary Examiner* — Wei (Victor) Y Chan
(74) *Attorney, Agent, or Firm* — Robert W. Morris; Eckert Seamans Cherin & Mellott, LLC

(57) ABSTRACT

A system for providing electrical power to various lighting fixtures is disclosed. In an exemplary embodiment, the system may include a lighting control panel, which may include multiple relays electrically coupled to a power source. The power source may be an LED driver. The system may also include multiple lighting fixtures electrically coupled to the lighting control panel such that the power source is operable to provide electrical power to the lighting fixtures. A first relay of the multiple relays may be operable to transfer power received from the power source to a first lighting fixture of the lighting fixtures, and a second relay of the multiple relays may be operable to transfer power received from the power source to a second lighting fixture of the lighting fixtures.

9 Claims, 3 Drawing Sheets

SYSTEM FOR ELECTRICAL LIGHTING FIXTURES

BACKGROUND OF THE INVENTION

This invention relates to automatic lighting systems using low voltage light sources.

SUMMARY OF THE INVENTION

In various embodiments, a system is provided. In an exemplary embodiment, the system may include a lighting control panel, the lighting control panel including a power source and multiple relays electrically coupled to the power source. The system may also include multiple lighting fixtures electrically coupled to the lighting control panel such that the power source is operable to provide electrical power to the plurality of lighting fixtures. A first relay of the plurality of relays may be operable to transfer power received from the power source to a first lighting fixture of the lighting fixtures, and a second relay of the plurality of relays may be operable to transfer power received from the power source to a second lighting fixture of the plurality of lighting fixtures.

DETAILED DESCRIPTION

Automatic lighting systems provide various benefits to users. In a bedroom, it is useful to allow a user to enter a closet without having to fumble for a light switch every time they wish to enter or use the closet. In kitchens, basements, laboratories, and workspaces, among others, it can be very helpful to illuminate a cabinet or drawer when the cabinet or drawer is opened.

However, these systems require power, and often times an independent power source is provided for each light source. This has a number of drawbacks. For instance, having multiple drivers throughout a system may be overly cumbersome. Additionally, it's an extraordinary waste of resources to use multiple drivers when one would suffice. This waste can include financial and environmental waste. As such, there is a need for an alternative system that uses fewer resources and provides optimal performance.

Figure 1:
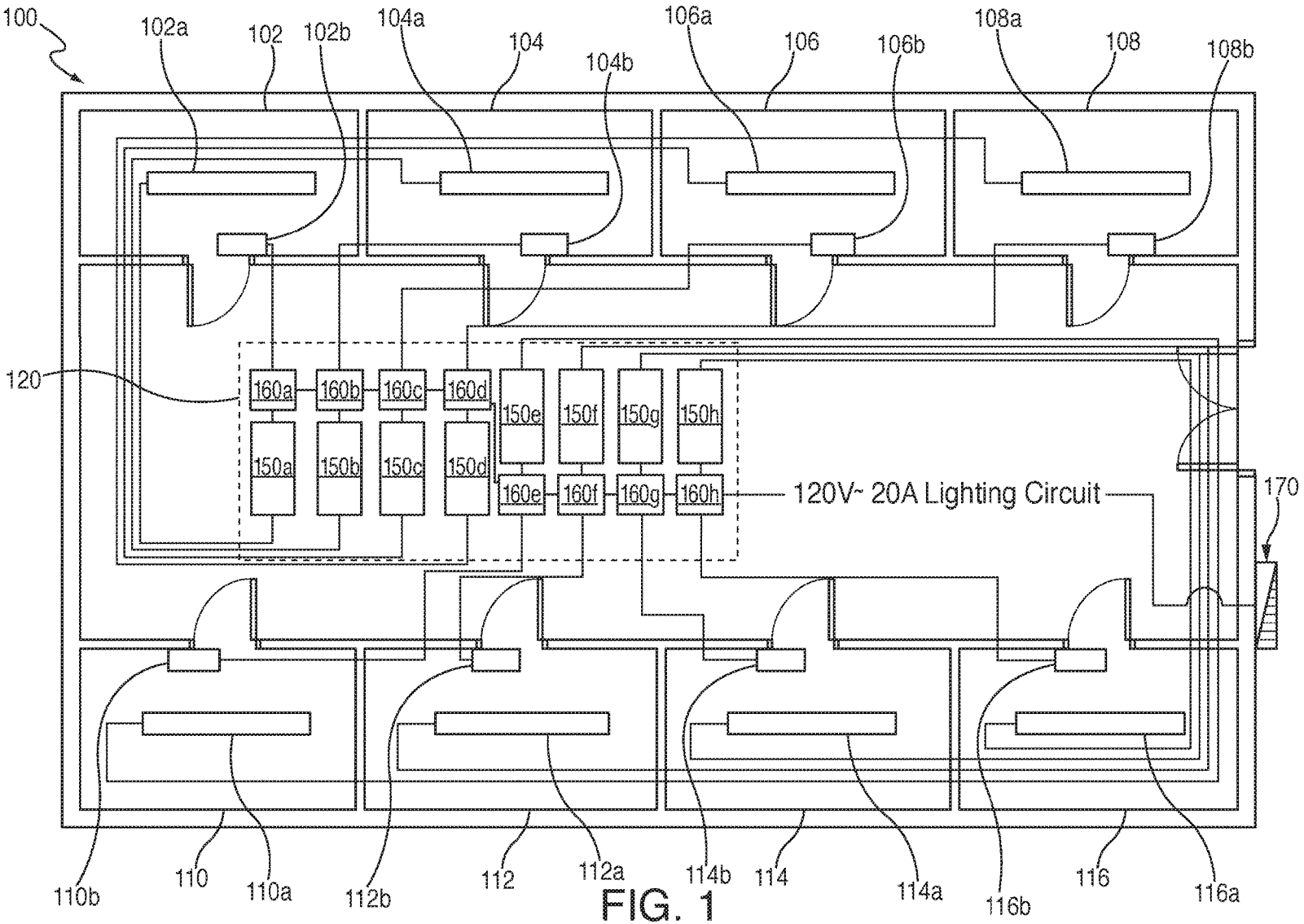
FIG. 1 (PRIOR ART)
FIG. 1 is a prior art system for providing electrical power to lighting fixtures.

FIG. 1 is a prior art system for providing electrical power to lighting fixtures. System 100 includes a plurality of stations 102, 104, 106, 108, 110, 112, 114, and 116 (collectively "stations 102-116"), each of which include lighting fixtures 102*a*, 104*a*, 106*a*, 108*a*, 110*a*, 112*a*, 114*a*, and 116*a* (collectively "fixtures 102*a*-116*a*") and door jamb switches 104*b*, 106*b*, 108*b*, 110*b*, 112*b*, 114*b*, and 116*b* (collectively "stations 102*b*-116*b*"). System 100 also includes access panel 120, which houses LED drivers 150*a*-150*h* and door type relays 160*a*-160*h*, and is electrically coupled to electrical panel 170.

As shown in FIG. 1, the prior art system includes several drivers 150*a*-150*h*, each driver being electrically coupled to a corresponding lighting fixture. Each lighting fixture requires its own driver due to the door type relays controlling the primary side of the driver. For instance, station 102 includes lighting fixture 102*a* and door jamb switch 102*b*. When a user opens a door (or other point of entry for station 102) in order to access station 102, door jamb switch 102*b* is thereby activated. Upon activation, door jamb switch sends an electrical signal to relay 160*a* located in access panel 120. Relay 160 then sends an electrical signal to driver 150*a*, which is also located in access panel 120. The sending of an electrical signal from relay 160*a* to driver 150*a* causes driver 150*a* to send electrical power received from electrical panel 170 to lighting fixture 102*a*, thereby causing lighting fixture 102*a* to power on and generate light.

The system of FIG. 1 suffers from several drawbacks. For instance, the inclusion of one driver for each lighting fixture is tedious, and causes an overwhelming waste of resources. This can lead to substantial cost to the environment, as well as substantial financial costs in constructing and maintaining such a system. Additionally, drivers tend to be considerably large. As a result, access panels are required to be larger than would be desired, causing them to be placed in inconvenient locations that can make operating and repairing system 100 difficult. Accordingly, the various embodiments of the present invention eliminates these problems through the systems described herein.

Figure 2:
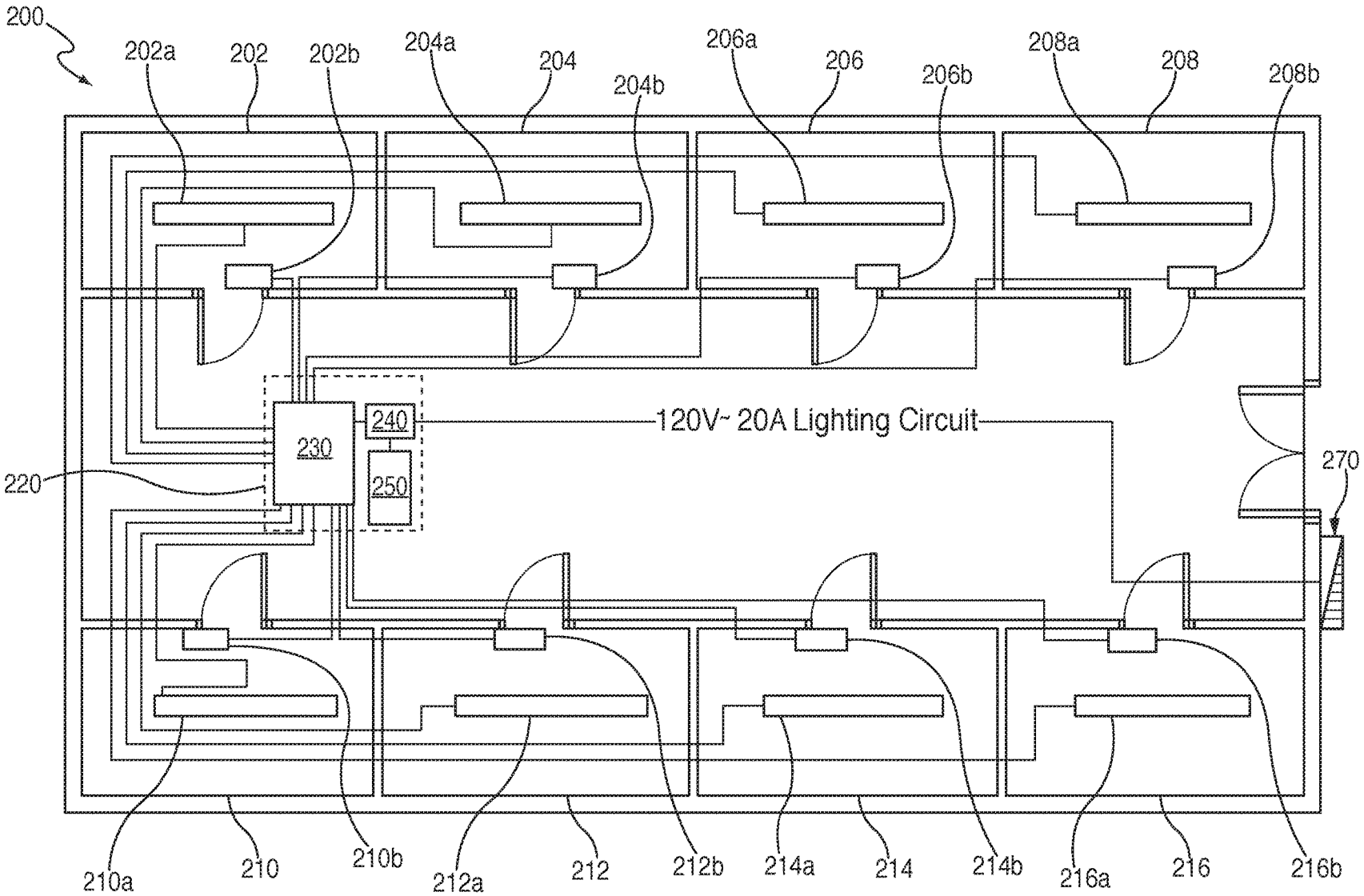
FIG. 2 is a system, in accordance with various embodiments.

FIG. 2 is a system, in accordance with various embodiments. FIG. 2 shows system 200 including stations 202, 204, 206, 208, 210, 212, 214, and 216 (collectively "stations 202-216") each of which includes a lighting fixture 202*a*, 204*a*, 206*a*, 208*a*, 210*a*, 212*a*, 214*a*, and 216*a* (collectively "fixtures 202*a*-216*a*") and a door jamb switch 202*b*, 204*b*, 206*b*, 208*b*, 210*b*, 212*b*, 214*b*, and 216*b* (collectively "switches 202*b*-216*b*"). System 200 also includes access panel 220, lighting control panel 230, service disconnect switch 240, and driver 250.

Stations 202-216 may be any area wherein a light may be found. For instance, stations 202-216 may be closets, small rooms, large rooms, cabinets, drawers, etc., or some combination thereof. As stated above, each station 202-216 includes a lighting fixture. Lighting fixtures 202*a*-216*a* may be any lighting fixture known in the art. For instance, in an exemplary embodiment, lighting fixtures 202*a*-216*a* may be low voltage linear light emitting diodes. Each station 202-216 may also include a door jamb switch 202*b*-216*b*. Switches 202*b*-216*b* may be used to activate corresponding lighting fixtures included in automatic lighting system 200 upon detection of a specific occurrence. For instance, switches 202*b*-216*b* may be configured to activate upon the opening of a door.

Upon opening a door, an electrical circuit in switch 202*b* may transform from an open position during which power is not being sent from switch 202*b*, to a closed position during which electricity may be generated from switch 202*b*, such that an electrical signal may be transmitted from switch 202*b* to lighting control panel 230 located in access panel 220. Located within lighting control panel 230 is are multiple relays. Each relay corresponds to a specific room and is electrically coupled to the switch in that room. Thus, switch 202*b*, upon activation (e.g., upon the opening of a door), may send an electrical signal to a corresponding relay within lighting control panel 230. The corresponding relay within lighting control panel 230 may then send electrical power from driver 250, which is receiving constant power from service disconnect switch 240. This activates the secondary side of the driver 250 to in turn send electrical power received from electrical panel 270 to lighting fixture 202*a*, thereby illuminating closet 202.

In another embodiment, driver 250 may be continuously active. As such, upon receiving an electrical signal from switch 202*b*, lighting control panel 230 may send a corresponding electrical signal to relays within lighting control panel 230. System 200 may include multiple switches, each switch being coupled to a corresponding relay. Accordingly, a switch within system 200 electrically coupled to a relay that corresponds to lighting fixture 202*a* may transition from an open circuit position in which electrical power received from driver 250 is not being forwarded via corresponding relay, to a closed circuit position in which electrical power received from driver 250 is forwarded via relay, which in turn sends the electrical power to lighting fixture 202*a*.

In yet another embodiment which will be described in greater detail in FIGS. 3A and 3B, lighting control panel 230 may include multiple relays that include contactors for regulating the flow of electrical current. For instance, service disconnect switch 240 may be in an "on" or closed circuit position, allowing a flow of current from driver 250 to a relay's contactor that is in an open circuit position such current does not flow from the relay to, for instance, lighting fixture 202*a*. Upon the relay's coil receiving an electrical signal from switch 202*b*, however, the relay's (normally open) contactor may change from the open position to a closed position allowing a flow of current received by the relay from driver 250 (via service disconnect switch 240) to pass from the relay to lighting fixture 202*a*, thereby turning lighting fixture 202*a* "on" and causing lighting fixture 202*a* to generate light.

In an embodiment, switch 240 may include circuitry for connecting or disconnecting lighting control panel 230 and driver 250 from power 270 as needed. If switch 240 is in an open or "off" position, the electrical circuit connecting system 200 to electrical panel 270 will be open, and thus current may not flow from electrical panel 270 to lighting control panel 230, and driver 250. If switch 240 is in a closed or "on" position, the electrical circuit is closed, and thus current may flow to lighting control panel 230, and driver 250 from electrical panel 270, and power may thereby be generated by electrical panel 270 to fixtures 202*a*-216*a*. In an embodiment, stations 202-216 may include user operated switches of their own that communicate with lighting control panel 230 such that power is received from lighting control panel 230 upon activation of a user operated switch by a user, so that lighting fixtures 202*a*-216*a* are activated and/or deactivated not only due to any automated process, but additionally (or alternatively) by some action by a user.

Figures 3A, 3B:
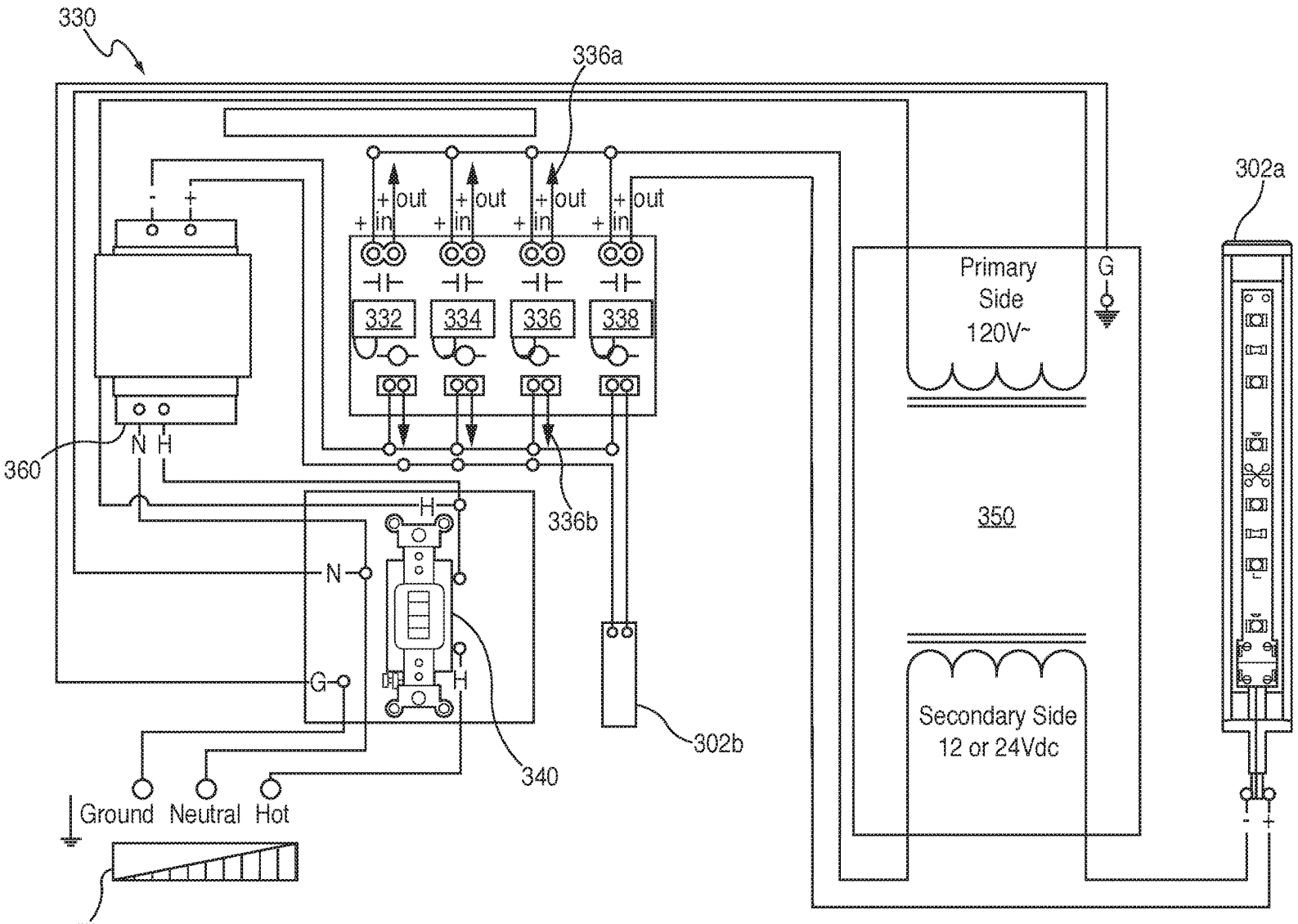
FIGS. 3A and 3B are schematic diagrams of a lighting control panel and an LED driver, in accordance with various embodiments.

FIGS. 3A and 3B are schematic diagrams of a lighting control panel 330 and LED driver 350, in accordance with various embodiments. In an exemplary embodiment, lighting control panel may be coupled to driver 350 and electrical panel 370, and may include relays 332-338. In an embodiment, lighting control panel may also include control circuit power supply 360 (which may be housed in lighting control panel 330). Generally speaking however, lighting control panel may include one or more LED drivers 350 (depending on the total load of the lighting fixtures in the system); as many as needed to drive power to one or more lighting fixtures. Because the relay's contactors are controlling the secondary side of the LED driver (as shown in the embodiment of FIGS. 3A and 3B), one driver 350 may provide power to lighting fixtures 202*a*-216*a* through each lighting fixture's corresponding relay's output terminals.

As stated above, lighting control panel may include one or more relays 332-338, which may be used to direct power received from electrical panel 370 via driver 350 to one or more lighting fixtures (e.g., fixtures 202*a*-216*a*). Relays 332-338 may each include an input channel and an output channel. Persons of ordinary skill in the art will appreciate that input channels are used to receive electrical current, while outputs are used to transfer out electrical current.

For instance, in an exemplary embodiment, relay 332 may be electrically coupled to lighting fixture 302*a* via an output channel and to switch 302*b* via an input channel. Thus, a coil in relay 332 may be structured such that upon receiving an electrical signal from switch 302*b* via an input channel located on the coil in relay 332, a contactor in relay 332 may then direct electrical power from driver 350 (which in turn may receive power from electrical panel 370) towards lighting fixture 302*a* via an output channel located on the contactor of relay 332. [20] The following exemplary scenario may be helpful to better understand the invention in various embodiments. A user may wish to gain access to a cabinet that includes lighting fixture 302*a*. Accordingly, the user may open a door coupled to switch 302*b*. Prior to the user opening the door, switch 302*b* may be in an open position such that current is not flowing through switch 302*b*, and as such no electrical signal is being sent from switch 302*b* to another component within the system. Upon opening the door, however, switch 302*b* may change to a closed position such that current flows through switch 302*b*, and as such an electrical signal may thereby be sent from switch 302*b* to, for instance, a coil in relay 332 at an input channel located thereon. Relay 332 may be electrically coupled to control circuit power supply 360, which may provide the coil in relay 332 with a source of electrical power via the circuit that it forms with door jamb switch 202*b*. A contactor in relay 332 may also be electrically coupled to driver 350 via service disconnect switch 340, which acts as a controllable conduit through which current may flow from driver 350 to the contactor in relay 332. The flow of current from switch 302*b* to the coil in relay 332 may cause the contactor located within relay 332 to change from an open position (i.e., an inactive position where current does not flow and no electrical power is being provided by relay 332) to a closed position, allowing current to flow through relay 332 from its contactor via an output channel on relay 332. At the output channel, the contactor in relay 332 may be electrically coupled to lighting fixture 302*a*. Thus, upon changing from an open position to a closed position, relay 332 may allow electrical power received from driver 350 to flow to lighting fixture 302*a*, thereby turning lighting fixture 302*a* "on" such that may generate light.

The benefits of the present invention are derived in part from the power being received from electrical panel 370 to the primary side of driver 350, rather than from a relay (as previously provided in the prior art). In the present invention, hot and neutral lines from switch 340 form an electrical circuit with the primary side of driver 350. At the primary side, driver 350 receives 120 volts of alternating current from switch 340, which in turn receives power from electrical panel 370. Within driver 350, the electrical current is "stepped-down" to a lower voltage of direct current at the secondary side of driver 350. Thus, driver 350 is constantly receiving power and is "always on" (switch 340 is used to open the circuit and thereby cutoff power from the rest of the system). From the secondary side, electrical current flows to a contactor in, for instance, relay 332, then from the contactor through an output channel to lighting fixture 302*a*, and then from the negative end of lighting fixture 302*a* to the secondary side of driver 350, thus closing the circuit. [22] In contrast, in the prior art, relays are connected to, and thereby control the flow of electrical current to, the primary side of a driver (a door type relay is designed to use 120 volts of alternating current to operate and 120 volts of alternating current to control the electrical current). What this means is that in the prior art, one relay would determine whether any electrical power could be received by a driver from an electrical power source. If multiple relays are electrically coupled in serial to the primary side of a driver, each relay would have to be activated in order for the driver to receive electrical power from the electrical power source, because if one relay is inactive, the electrical circuit is open, and electrical current cannot flow through the circuit. If multiple relays are electrically coupled in parallel to the primary side of a driver, each relay would have to be deactivated in order for the driver to not receive electrical power from the electrical power source, because if one relay is active, the electrical circuit is closed, and electrical current flows through the circuit. Thus, in order for multiple lighting fixtures to be capable of independently receiving power, the prior art requires that each driver be coupled to a single relay at the driver's primary side, and the relay would be coupled to a single door jamb switch corresponding to an individual lighting fixture within a system. This is highly inefficient, and it would be preferable to only use one driver (or at least fewer drivers than are presently used in the prior art) to power multiple lighting fixtures.

Thus, as shown in the present invention, a driver may be electrically coupled directly to the electrical power source (or through a service disconnect switch) at the primary side of the driver, and the driver may also be electrically coupled to multiple relays (and multiple lighting fixtures) at the secondary side of the driver, thereby allowing each individual relay to determine whether its corresponding lighting fixture receives power.

Persons of ordinary skill in the art will appreciate that the present invention is not limited to only the embodiments described, instead, the present invention more generally involves dynamic information. The embodiments described herein are presented only for purposes of providing exemplary forms of the present invention, and are not presented for any limiting purposes. Persons skilled in the art will also appreciate that the systems of the present invention may be implemented in other ways than those described herein. All such modifications are within the scope of the present invention.

What is claimed is:

1. A system, comprising:

a power source comprising a primary side configured to receive an alternating current and a secondary side configured to receive the alternating current from the primary side and step-down the alternating current to a low voltage of direct current;

a lighting control panel comprising a plurality of relays electrically coupled to the power source at the secondary side; and a plurality of lighting fixtures electrically coupled to the lighting control panel and the power source at the secondary side on a negative end such that the power source is constantly on and operable to provide electrical power to the plurality of lighting fixtures;

wherein a first relay of the plurality of relays is operable to provide the stepped-down low voltage received from the secondary side of the power source to a first lighting fixture of the plurality of lighting fixtures, and a second relay of the plurality of relays is operable to provide the stepped-down low voltage received from the secondary side of power source to a second lighting fixture of the plurality of lighting fixtures.

2. The system of claim 1, further comprising:

a first electrical switch electrically coupled to the first relay, the first electrical switch being in a first position; and a second electrical switch electrically coupled to the second relay, the second electrical switch being in a second position.

3. The system of claim 2, wherein the first position allows the first electrical switch to communicate with the first relay such that electrical power received from the power source is provided by the first relay to the first lighting fixture.

4. The system of claim 3, wherein the second electrical switch is operable to change from the second position to a third position, such that in the third position, the second electrical switch begins communicating with the second relay such that electrical power received from the power source is provided by the second relay to the second lighting fixture.

5. The system of claim 2, wherein the power source and the plurality of relays are located apart from the plurality of light fixtures and the first and second electrical switch.

6. The system of claim 2, further comprising a service disconnect switch operable to electrically decouple the power source from the plurality of relays.

7. The system of claim 6, wherein the service disconnect switch, the power source, and the plurality of relays are located apart from the plurality of light fixtures and the first and second electrical switch.

8. The system of claim 1, wherein the power source is electrically coupled at the primary side to a service disconnect switch.

9. The system of claim 8, wherein the power source is electrically coupled at the secondary side to the first relay and the first lighting fixture, and wherein the first relay is electrically coupled to the first lighting fixture.

* * * * *